US009305528B1

(12) United States Patent
Chen

(10) Patent No.: US 9,305,528 B1
(45) Date of Patent: Apr. 5, 2016

(54) CLAMPING DEVICE FOR HOLDING SHOULDER REST TO VIOLIN AND VIOLA

(71) Applicant: Kuan-Hung Chen, Taipei (TW)

(72) Inventor: Kuan-Hung Chen, Taipei (TW)

( * ) Notice: Subject to any disclaimer, the term of this patent is extended or adjusted under 35 U.S.C. 154(b) by 0 days.

(21) Appl. No.: 14/518,084

(22) Filed: Oct. 20, 2014

(51) Int. Cl.
*G10D 3/18* (2006.01)
*G10D 1/02* (2006.01)

(52) U.S. Cl.
CPC ... *G10D 3/18* (2013.01); *G10D 1/02* (2013.01)

(58) Field of Classification Search
CPC ..... G10D 3/18; G10D 1/02; G10D 1/005; G10G 5/005; G10G 5/00; G10H 1/32
USPC ..... 84/278–280
See application file for complete search history.

(56) References Cited

U.S. PATENT DOCUMENTS 3,727,509 A * 4/1973 Henkle ..... G10D 3/18 84/278
5,208,409 A * 5/1993 Roulet ..... G10D 3/18 84/278

* cited by examiner

*Primary Examiner* — Kimberly Lockett
(74) *Attorney, Agent, or Firm* — Jackson IPG PLLC; Demian K. Jackson

(57) ABSTRACT

A clamping device for holding shoulder rest to violin and viola includes a holding member, a plurality of clamping members, and a shaft. The holding member has a base portion and an extended portion outward extended from the base portion. The clamping members are connected to the extended portion. The shaft is extended through the clamping members and the extended portion. With these arrangements, a shoulder rest can be very conveniently assembled to a violin or a viola and can be freely adjusted in angle for use.

13 Claims, 10 Drawing Sheets

CLAMPING DEVICE FOR HOLDING SHOULDER REST TO VIOLIN AND VIOLA

FIELD OF THE INVENTION

The present invention relates to a clamping device, and more specifically, to a clamping device for holding shoulder rest to violin and viola that can very conveniently hold a shoulder rest to a violin or a viola and allows the shoulder rest to be freely adjusted in angle for use.

BACKGROUND OF THE INVENTION

The currently available shoulder rest for violin or viola has two functions. One of the functions is to allow a more comfortable posture while plying the violin or the viola. People's necks are different in length. However, even for a person with a short neck, the length from the chin to the collarbone is much larger than an overall thickness of the violin or the viola plus a chin rest mounted thereto. When intending to hold the violin or the viola in the most comfortable place for playing, the player generally needs to lift his shoulder or turn or tilt his head leftward. These postures result in tense shoulder and neck, which tends to develop an occupational disease over time. By using the shoulder rest, the above conditions can be effectively relieved.

The most valuable component of the violin or the viola is the back thereof. The texture and the place of origin of the back all are key factors that determine the value and the timbre of the violin or the viola. Without using the shoulder rest, the player's shoulder is in direct contact with the back of the violin or the viola. Normally, the player holds the violin or the viola in place with his chin and shoulder. This posture also holds the back from vibrating. When using a shoulder rest, two feet of the shoulder rest are firmly attached to the edge of the back of the violin or the viola, such that there is a space between the shoulder rest and the back, allowing the back to fully vibrate and produce a resonance effect.

Please refer to FIG. 1. A conventional shoulder rest 11 has a curved surface for placing on a player's shoulder. The shoulder rest 11 has two feet 12, with which the shoulder rest 11 can be firmly attached to between two sides of the violin or the viola. Since the shoulder rest 11 is heavy with poor softness, and the player cannot freely adjust it to different angles relative to the violin or the viola, the sound quality produced by the violin or the viola during play is adversely affected. Since the feet 12 of the shoulder rest 11 are tightly attached to two sides of the violin or the viola, the resonance effect is adversely affected due to the great pressure applied to the violin or the viola by the feet 12 of the shoulder rest 11. In addition, the shoulder rest 11 is not easily correctly adjusted in its angle relative to the violin or the viola, and is directly in frictional contact with the violin or the viola to cause damage to the violin or the viola and the sound quality thereof.

Moreover, when playing a violin or a viola with the currently available shoulder rest mounted thereto, usually the player will press his neck against the tailpiece, support the neck of the violin or the viola with one hand, and hold the bow with another hand. This posture tends to cause sore neck, tilt head and sloped shoulder to affect the effective time and quality of practicing and playing the violin or the viola.

In brief, the prior art shoulder rest for the violin and the viola has the following disadvantages: (1) inconvenient for assembling to a violin or a viola; (2) not freely adjustable in angle for use; (3) reducing the effective time and quality of violin or viola practice; and (4) uncomfortable for use.

It is therefore tried by the inventor to develop an improved clamping device for holding shoulder rest to violin and viola to overcome the drawbacks and problems in the prior art.

SUMMARY OF THE INVENTION

A primary object of the present invention is to provide a clamping device for holding shoulder rest to violin and viola that can very conveniently assemble a shoulder rest to a violin or a viola.

Another object of the present invention is to provide a clamping device for holding shoulder rest to violin and viola that allows a shoulder rest to be freely adjusted in angle for use.

A further object of the present invention is to provide a clamping device for holding shoulder rest to violin and viola that makes violin or viola practice more efficiently.

A still further object of the present invention is to provide a clamping device for holding shoulder rest to violin and viola that makes a user more comfortable when practicing violin or viola.

To achieve the above and other objects, the clamping device for holding shoulder rest to violin and viola provided according to the present invention includes a holding member, a plurality of clamping members, and a shaft. The holding member has a base portion and an extended portion outward extended from the base portion. The clamping members are connected to the extended portion. The shaft is extended through the clamping members and the extended portion.

To use a shoulder rest, a user can first assemble the clamping device to the shoulder rest by attaching one side of the base portion to the shoulder rest and then connecting the clamping members to a chin rest that is mounted on the violin and has a plurality of fixing rods. After the fitting portions are fitted around the fixing rods of the chin rest, the shoulder rest is very conveniently held to the violin via the clamping device and the chin rest. Furthermore, with the clamping device of the present invention, the shoulder rest can be freely adjusted in angle for use, making violin practice more efficient and reducing the user's discomfort when practicing the violin.

BRIEF DESCRIPTION OF THE DRAWINGS

The structure and the technical means adopted by the present invention to achieve the above and other objects can be best understood by referring to the following detailed description of the preferred embodiment and the accompanying drawings, wherein.

DETAILED DESCRIPTION OF THE PREFERRED EMBODIMENTS

Figure 1:
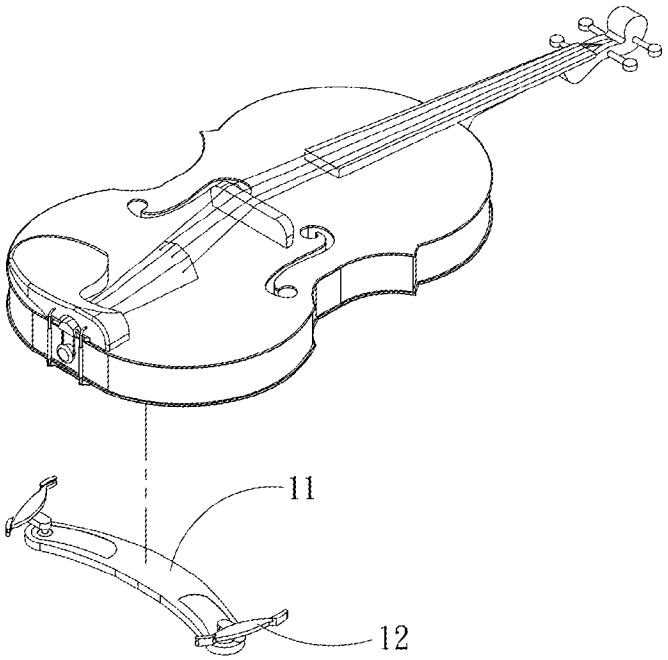
(PRIOR ART) Fig. 1
FIG. 1 is an exploded perspective view showing a conventional manner of connecting a shoulder rest to a violin or viola.

The present invention will now be described with some preferred embodiments thereof and by referring to the accompanying drawings. For the purpose of easy to understand, elements that are the same in the preferred embodiments are denoted by the same reference numerals.

Figure 2:
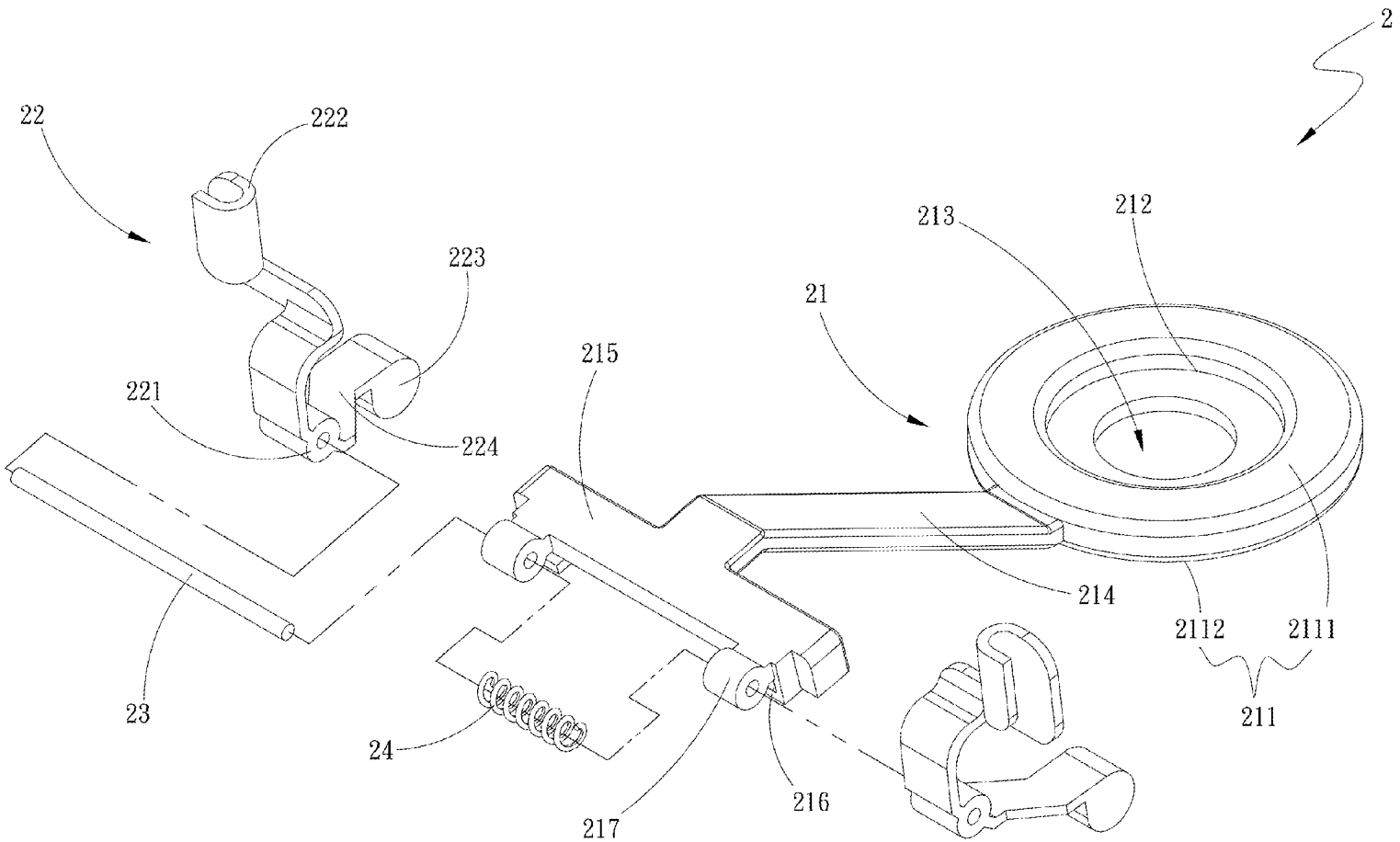
FIG. 2 is an exploded perspective view of a clamping device for holding shoulder rest to violin and viola according to a preferred embodiment of the present invention.
Figure 3:
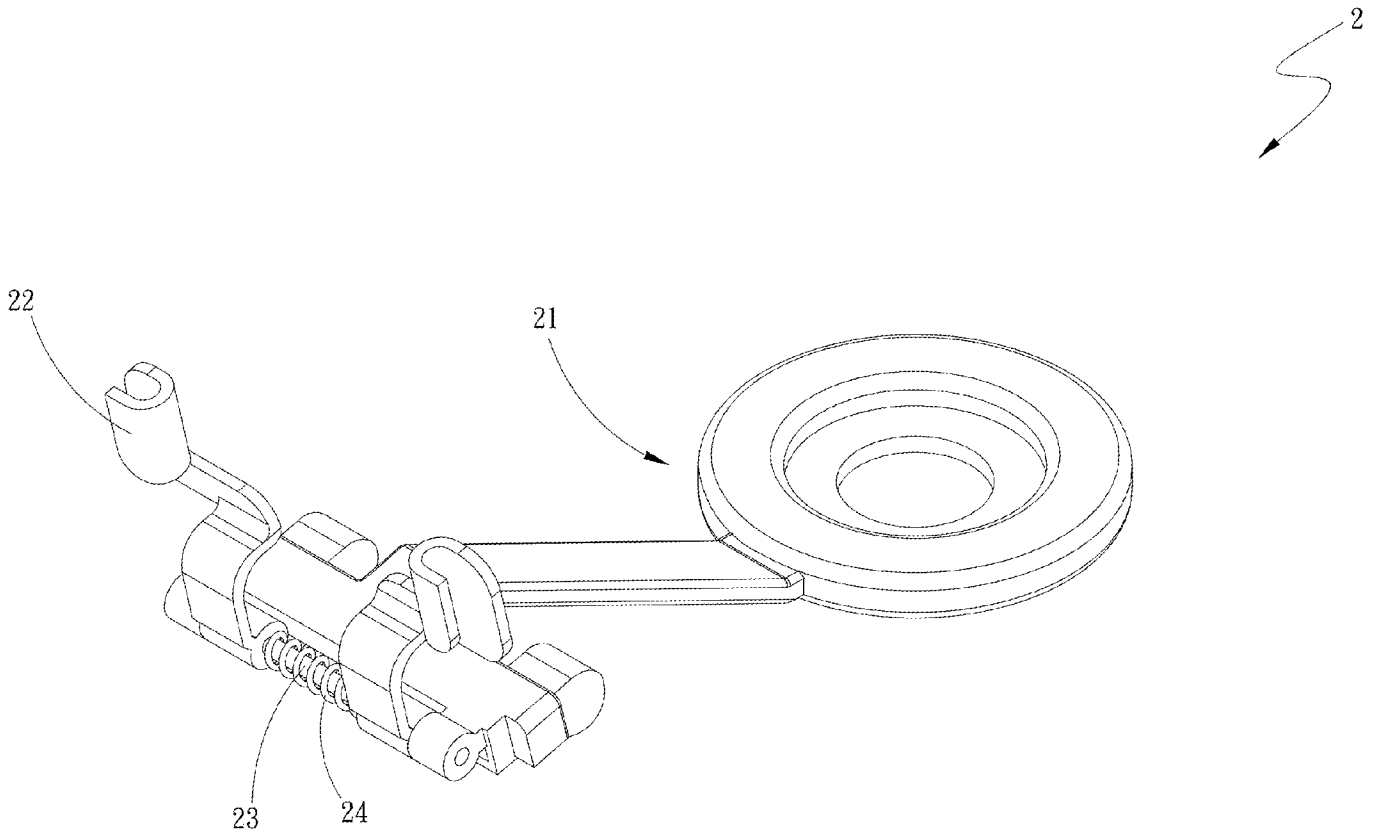
FIG. 3 is an assembled perspective view of FIG. 2.

Please refer to FIGS. 2 to 3, which are exploded and assembled perspective views, respectively, of a clamping device 2 for holding shoulder rest to violin and viola according to a preferred embodiment of the present invention. While the clamping device 2 can be used with both of the violin and the viola, sometimes only the violin is referred to herein for the purpose of conciseness. As shown, the clamping device 2 includes a holding member 21, a plurality of clamping members 22, and a shaft 23. The holding member 21 has a base portion 211 and an extended portion 214 outward extended from the base portion 211. One end of the extended portion 214 opposite to the base portion 211 is formed into a fixing portion 215. One side of the fixing portion 215 opposite to the base portion 211 is extended to form a plurality of connecting portions 217. And two ends of the fixing portion 215 are respectively downward extended to form a support portion 216.

The base portion 211 has a first side 2111 and an opposite second side 2112. The first side 2111 has a recess 212 and an opening 213 formed at a center of the recess 212. The opening 213 is extended though the first and the second side 2111, 2112

The clamping members 22 are connected to two ends of the fixing portion 215. Each of the clamping members 22 includes a butt joint portion 221 located at a central position thereof for correspondingly connecting to one connecting portion 217, a fitting portion 222 located at an end of the butt joint portion 221, and a pressing portion 223 located at another end of the butt joint portion 221. A holding portion 224 is defined between the butt joint portion 221 and the pressing portion 223 for fitting in the support portion 216.

The shaft 23 is extended through the connecting portions 217 and the butt joint portions 221; and the shaft 23 has an elastic element 24 fitted therearound.

Figure 4:
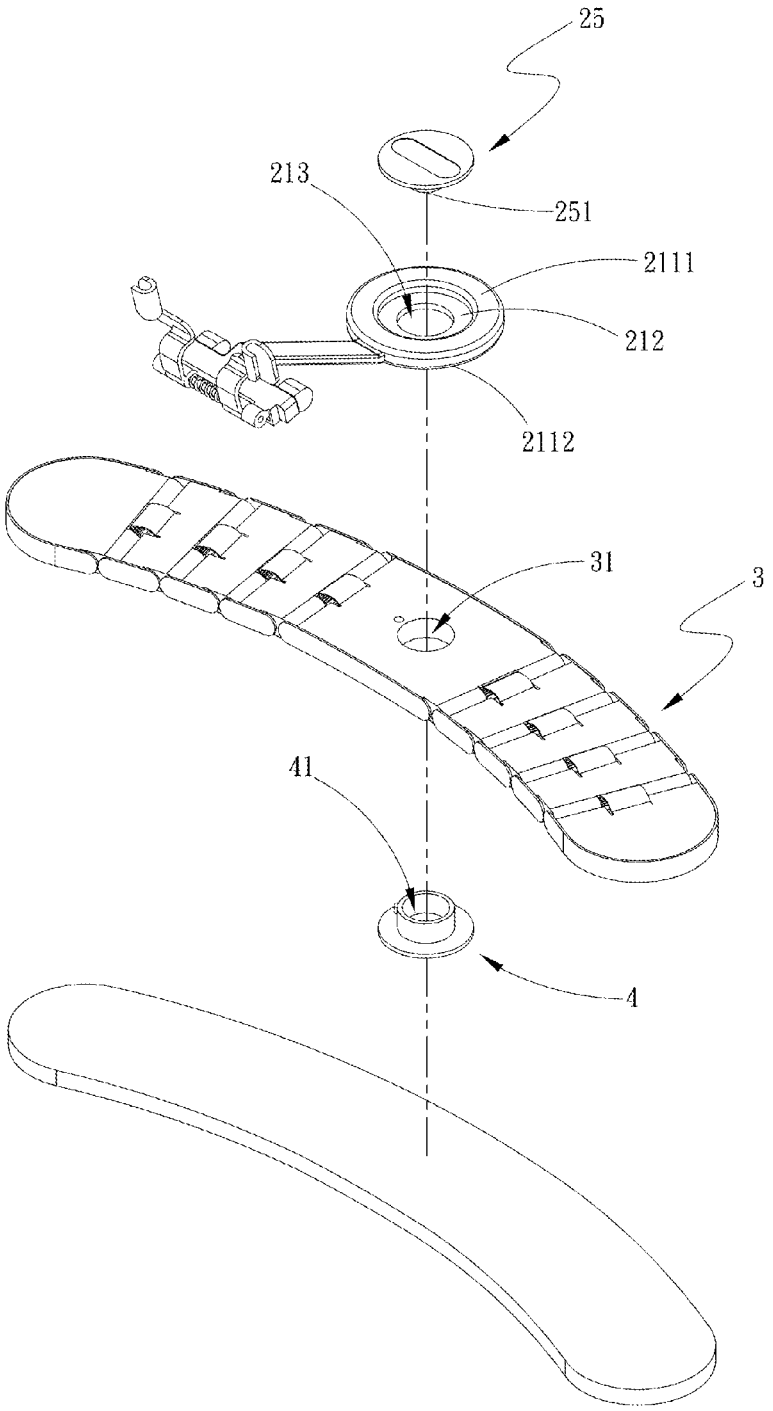
FIG. 4 is an exploded perspective view showing the connection of the clamping device of the present invention to a shoulder rest.
Figure 5:
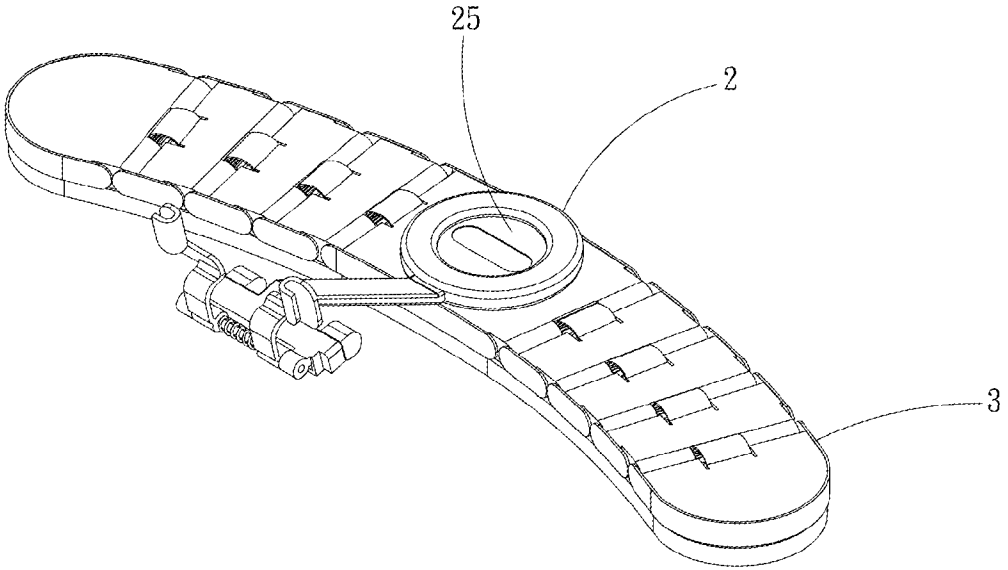
FIG. 5 is an assembled perspective view of FIG. 4.

Please refer to FIGS. 4 and 5, which are exploded and assembled perspective views, respectively, showing the connection of the clamping device 2 of the present invention to a shoulder rest 3. As shown, the recess 212 on the first side 2111 receives a cover 25 therein. The cover 25 has an engaging portion 251 formed at a lower central position thereof. The engaging portion 251 is extended through the opening 213. The second side 2112 of the holding member 21 is assembled to the shoulder rest 3. The shoulder rest 3 has a through hole 31. The engaging portion 251 is correspondingly extended through the opening 213 and the through hole 31.

Moreover, the clamping device 2 further includes a base 4 connected to the through hole 31 of the shoulder rest 3; and the base 4 defines a receiving space 41 to receive the engaging portion 251 therein.

Figure 6:
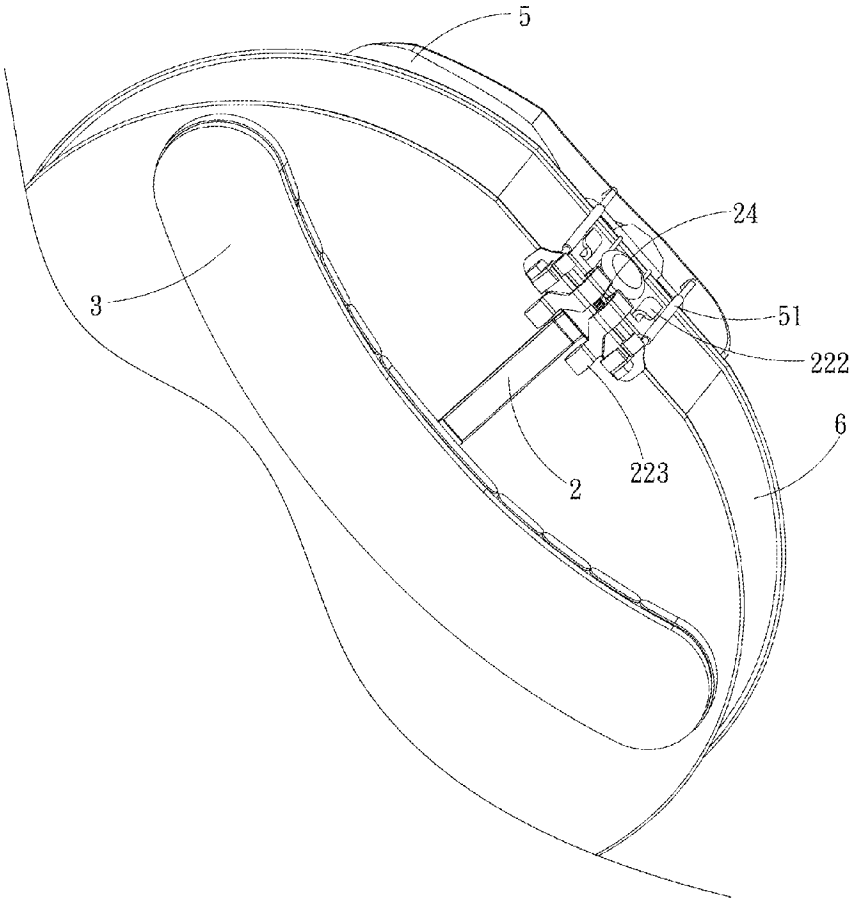
FIGS. 6, 7 and 8 show the use of the clamping device of the present invention to hold the shoulder rest to a violin.
Figure 7:
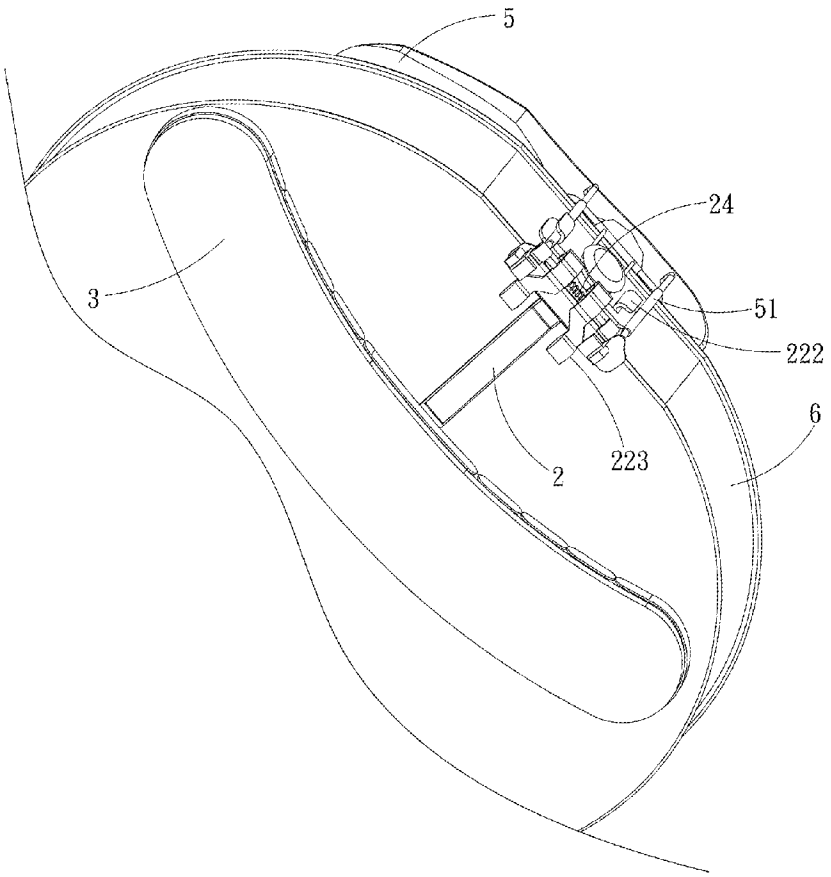
Figure 8:
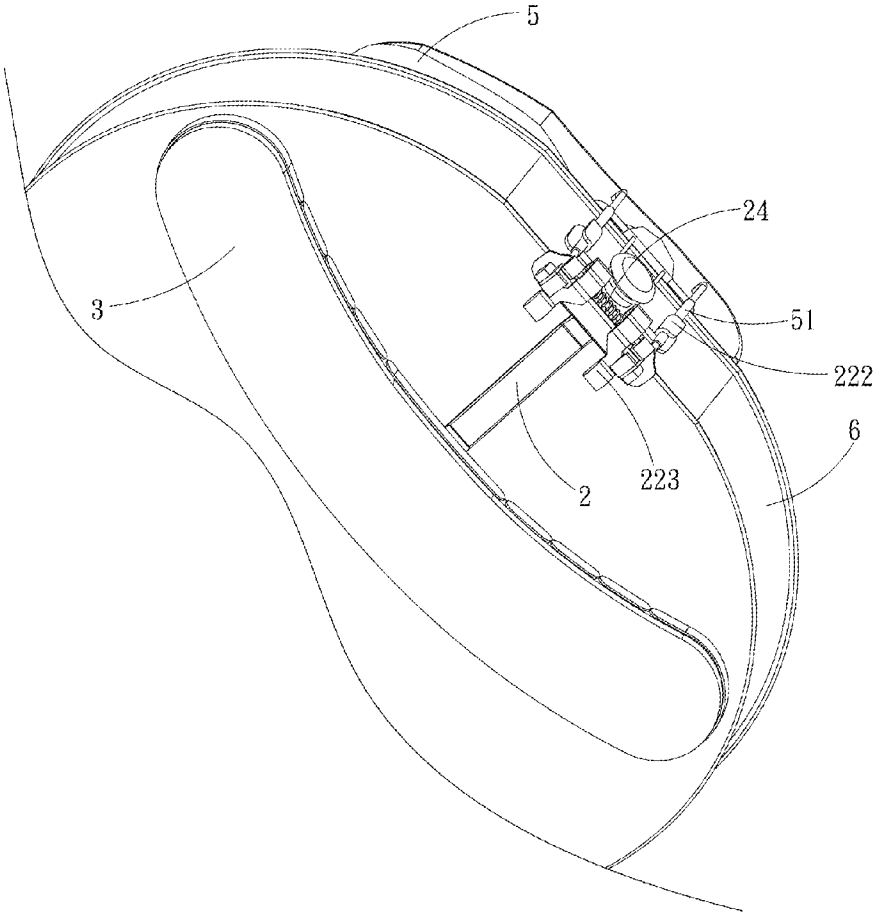

FIGS. 6 to 8 show the use of the clamping device 2 to hold the shoulder rest 3 to a violin 6. Please refer to FIGS. 6 to 8 along with FIG. 2. To assemble the shoulder rest 3 to a violin or a viola 6 via the clamping device 2, a user can attach the second side 2112 of the base portion 211 of the holding member 21 to the shoulder rest 3. First, the user presses the pressing portions 223 of the clamping members 22 toward each other, so that the elastic element 24 is compressed and the clamping members 22 are moved towards a center of the shaft 23 as shown in FIG. 6. Next, connect one of the fitting portions 222 of the clamping members 22 to a chin rest 5 that is mounted on the violin 6 and has a plurality of fixing rods 51, so the fitting portion 222 of the clamping member 22 is fitted around one of the fixing rods 51 as shown in FIG. 7. Finally, after another fitting portion 222 is fitted around another fixing rod 51, release the pressing portions 223, and the shoulder rest 3 is firmly held to the violin or the viola 6 via the clamping device 2 and the chin rest 5 as shown in FIG. 8. Therefore, the shoulder rest 3 can be very conveniently held to the violin or the viola 6.

Figure 9:
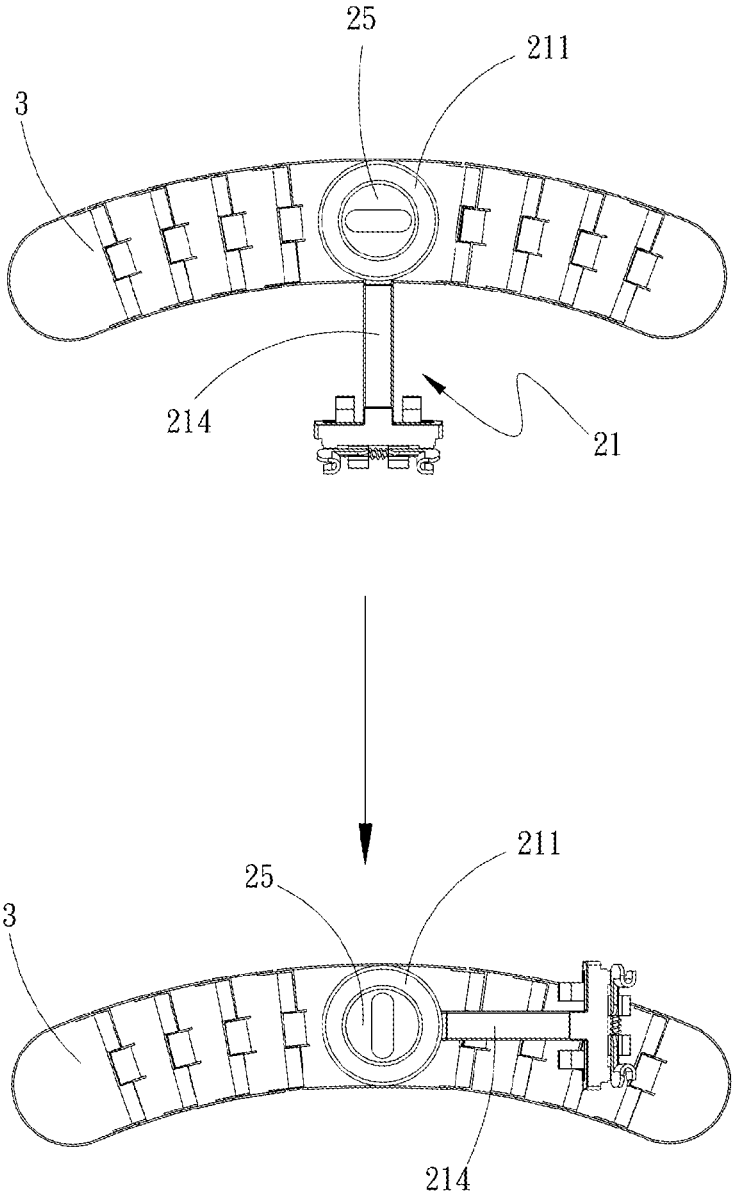
FIG. 9 shows the shoulder rest is turnably connected to the clamping device of the present invention.
Figure 10:
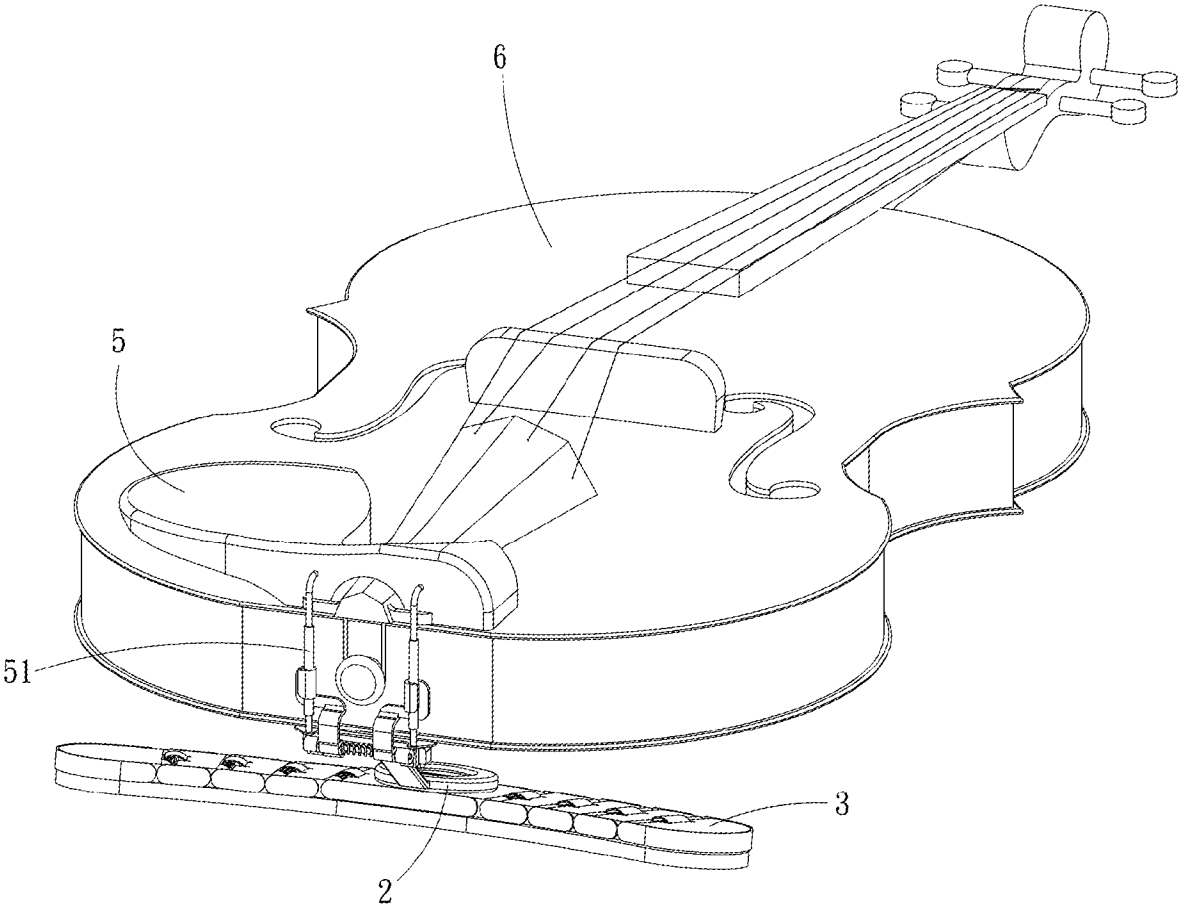
FIG. 10 is a perspective view showing the shoulder rest has been held to the violin via the clamping device of the present invention.

Please refer to FIG. 9, which shows the shoulder rest 3 is turnable relative to the clamping device 2 according to the preferred embodiment of the present invention, and to FIG. 10, which shows the shoulder rest 3 is held to the violin 6 via the clamping device 2. Since the clamping device 2 and the shoulder rest 3 are connected to each other via engagement of the cover 25 with the base 4, the user can turn the shoulder rest 3 rightward or leftward to a most comfortable angle for use. Further, since the extended portion 214 of the holding member 21 is made of a flexible metal material or a flexible non-metal material, the holding member 21 is bendable upward or downward to adjust the distance between the shoulder rest 3 and the user's chin and shoulder. Therefore, the user won't feel uncomfortable and get fatigued due to tilting his head or lifting his shoulder for long hours, making the violin practice more efficient.

With these arrangements, the present invention has the following advantages: (1) enabling a shoulder rest to be very conveniently assembled to a violin or a viola; (2) allowing the shoulder rest to be freely adjusted in angle for use; (3) making violin or viola practice more efficiently; and (4) making the user more comfortable when practicing the violin or viola.

The present invention has been described with some preferred embodiments thereof and it is understood that many changes and modifications in the described embodiments can be carried out without departing from the scope and the spirit of the invention that is intended to be limited only by the appended claims.

What is claimed is:

1. A clamping device for holding shoulder rest to violin and viola, comprising:

a holding member having a base portion and an extended portion outward extended from the base portion;

a plurality of clamping members being connected to the extended portion; and a shaft being extended through the clamping members and the extended portion, wherein one end of the extended portion opposite to the base portion is formed into a fixing portion, and the clamping members being connected to two ends of the fixing portion, and wherein one side of the fixing portion opposite to the base portion is extended to form a plurality of connecting portions, and each of the clamping members including a butt joint portion located at a central position thereof for correspondingly connecting to one of the connecting portions.

2. The clamping device for holding shoulder rest to violin and viola as claimed in claim 1, wherein each of the clamping members further includes a fitting portion located at an end of the butt joint portion and a pressing portion located at another end of the butt joint portion.

3. The clamping device for holding shoulder rest to violin and viola as claimed in claim 2, wherein the shaft is extended through the connecting portions and the butt joint portions, and has an elastic element fitted therearound.

4. The clamping device for holding shoulder rest to violin and viola as claimed in claim 1, wherein the base portion has a first side and an opposite second side; and the first side having a recess and an opening formed at a central position of the recess to extend though the first and the second side.

5. The clamping device for holding shoulder rest to violin and viola as claimed in claim 4, wherein the recess receives a cover therein; and the cover having an engaging portion formed at a lower central position for extending through the opening.

6. The clamping device for holding shoulder rest to violin and viola as claimed in claim 1, wherein two ends of the fixing portion are downward extended to respectively form a support portion.

7. The clamping device for holding shoulder rest to violin and viola as claimed in claim 6, wherein a holding portion is defined between the butt joint portion and the pressing portion of each clamping member for fitting in the support portion.

8. The clamping device for holding shoulder rest to violin and viola as claimed in claim 4, wherein the second side of the holding member is attached to a shoulder rest; the shoulder rest having a through hole; and the engaging portion of the cover being correspondingly extended through the opening and the through hole.

9. The clamping device for holding shoulder rest to violin and viola as claimed in claim 8, further comprising a base being connected to the through hole of the shoulder rest; and the base defining a receiving space for receiving the engaging portion therein.

10. The clamping device for holding shoulder rest to violin and viola as claimed in claim 1, wherein the clamping members are connected to a chin rest on the violin and viola; the chin rest having a plurality of fixing rods; and the fitting portion being fitted around the fixing rods.

11. The clamping device for holding shoulder rest to violin and viola as claimed in claim 1, wherein the extended portion of the holding member is made of material selected from the group consisting of a flexible metal material and a flexible non-metal material.

12. A clamping device for holding shoulder rest to violin and viola, comprising:

a holding member having a base portion and an extended portion outward extended from the base portion;

a plurality of clamping members being connected to the extended portion; and a shaft being extended through the clamping members and the extended portion, wherein the base portion has a first side and an opposite second side; and the first side having a recess and an opening formed at a central position of the recess to extend though the first and the second side, wherein the recess receives a cover therein, and the cover having an engaging portion formed at a lower central position for extending through the opening.

13. A clamping device for holding shoulder rest to violin and viola, comprising:

a holding member having a base portion and an extended portion outward extended from the base portion;

a plurality of clamping members being connected to the extended portion; and a shaft being extended through the clamping members and the extended portion, wherein the clamping members are connected to a chin rest on the violin and viola, the chin rest having a plurality of fixing rods, and the fitting portion being fitted around the fixing rods.

* * * * *